United States Patent [19]

Izzo

[11] Patent Number: 5,042,703

[45] Date of Patent: Aug. 27, 1991

[54] DUAL STRAP CARRYING SYSTEM FOR GOLF BAGS

[76] Inventor: Theodore-James Izzo, 6490 Kinney Creek Rd., Evergreen, Colo. 80439

[21] Appl. No.: 562,555

[22] Filed: Aug. 2, 1990

Related U.S. Application Data

[63] Continuation-in-part of Ser. No. 460,406, Jan. 3, 1990, Pat. No. 5,038,984, and Ser. No. 499,595, Mar. 23, 1990, Pat. No. 5,042,704.

[51] Int. Cl.[5] ..... A45F 3/04; A63B 55/00

[52] U.S. Cl. ..... 224/209; 224/202; 206/315.3; 206/315.5

[58] Field of Search ..... 224/209, 207, 202, 259, 224/264, 210–216, 201, 203–206; 206/315.1, 315.2, 315.3, 315.5, 315.7, 315.4, 315.6, 315.8

[56] References Cited

U.S. PATENT DOCUMENTS 2,820,498 1/1958 Endee ..... 206/315.5
3,622,056 11/1971 Droeger ..... 224/209
3,882,914 5/1975 Strutz ..... 206/315.5

*Primary Examiner*—Henry J. Recla
*Assistant Examiner*—David J. Walczak
*Attorney, Agent, or Firm*—John E. Reilly

[57] ABSTRACT

A dual shoulder strap assembly for a golf bag having first and second strap members connected in end-to-end relation to one another along one side of the golf bag, a handle grip interconnecting adjoining ends of the strap members, and circumferential loops serve to connect opposite extreme ends of the first and second strap members to the golf bag in such a way as to maintain the bag in centered relation against the back of the carrier when the straps are passed over the shoulders. The upper and lower extreme ends of the strap members are self-adjusting circumferentially, and the adjoining ends between the strap members are interconnected in such a way as to maintain the strap members in an elevated position so that the bag can be easily lifted off the ground and more easily placed on the shoulders of the carrier.

13 Claims, 4 Drawing Sheets

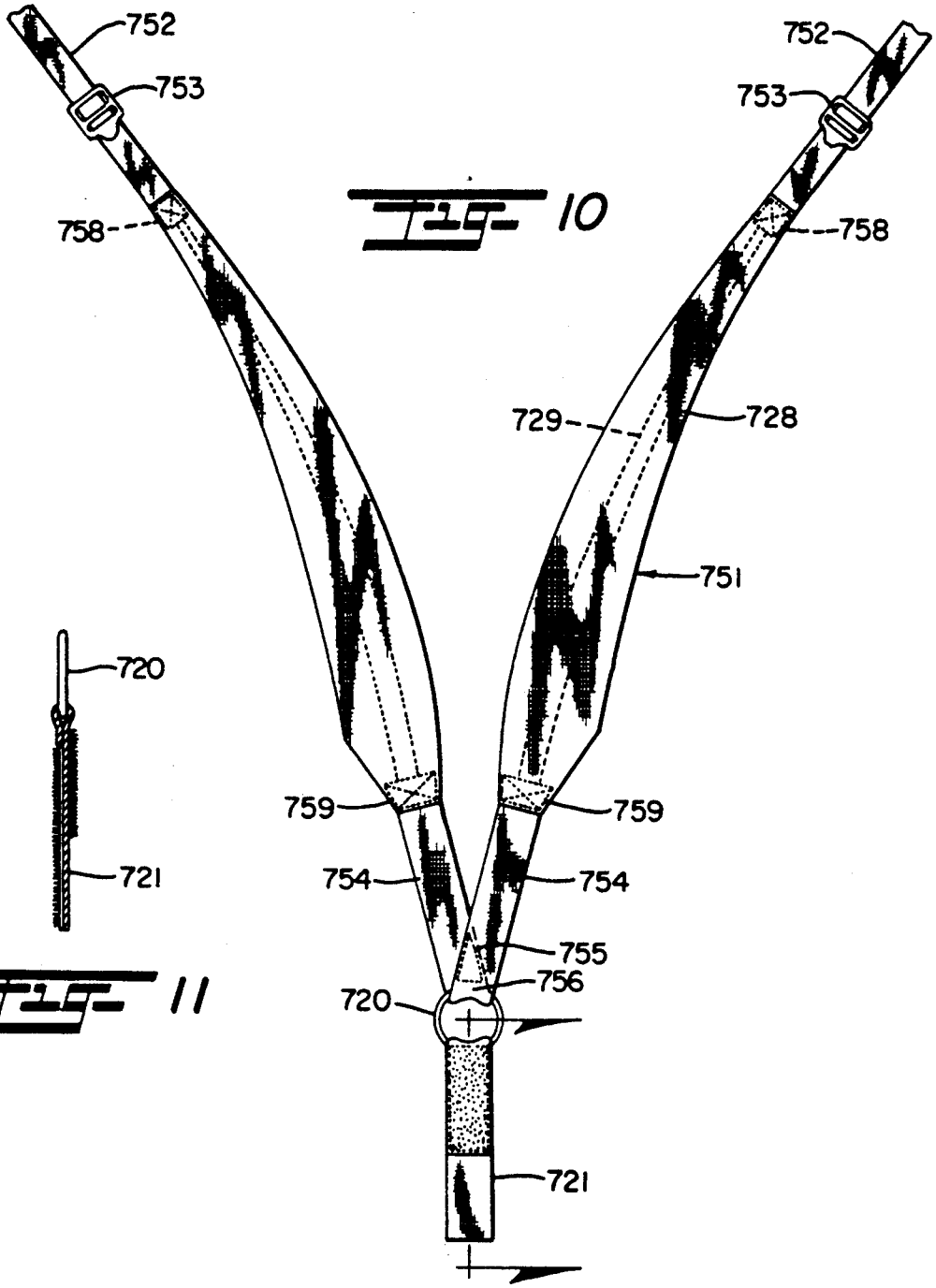
FIG. 10
FIG. 11
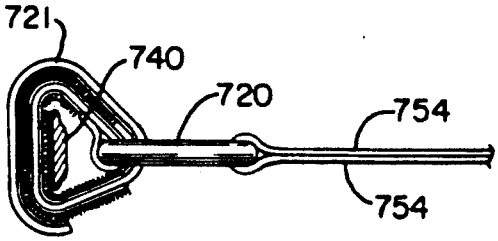
FIG. 12

DUAL STRAP CARRYING SYSTEM FOR GOLF BAGS

CROSS REFERENCE TO RELATED APPLICATIONS

The present invention is a continuation-in-part of my earlier applications Ser. No. 460,406, filed Jan. 3, 1990, now U.S. Pat. No. 5,038,984 and Ser. No. 499,595, filed Mar. 23, 1990, now U.S. Pat. No. 5,042,704 both entitled "DUAL STRAP CARRYING SYSTEM FOR GOLF BAGS".

This invention generally relates to golf bags; and more particularly to apparatus used in conjunction with golf bags to facilitate transport thereof by a person. Specifically, the present invention is directed to a novel and improved dual strap golf bag carrying system whereby a person may carry a golf bag either with a pair of straps placed across both shoulders and with the golf bag resting against his/her back or with a single strap in the traditional manner.

BACKGROUND OF THE INVENTION

The game of golf is one of the most widely enjoyed sports activities in the world. The number of persons participating in this activity, both at the professional and recreational level, is almost unparalleled. Not only is this activity already widespread, but the ranks of golfers continue to swell at an unprecedented rate.

The sport of golf is typically played on a course consisting of nine or eighteen holes. A set of clubs is used to strike a golf ball along the hole comprising the course. Each hole consists of a tee box which defines a starting location wherein a golfer places a ball and initially strikes the ball towards a green. Each green includes a recessed cup, and it is the object of the golfer to strike the ball with a series of strokes into the cup. Different clubs are used to vary the height, distance and spin of the ball. The holes normally vary in length from short holes of approximately one hundred yards to longer holes of five hundred yards and greater. The holes are flanked by rough areas out of which it is more difficult to play, and hazards are provided to increase the intricacy and precision required to play.

Golfers may travel over a course during play in a variety of manners. For example, a golfer may walk a course and carry his/her clubs or sometimes employs another to carry clubs for him/her. Other golfers employ wheeled pull carts which mountably receive a set of clubs so that a golfer may push or pull the cart as the golfer walks each hole. Motorized or engine-driven carts are available at some courses and, in fact, are required for play at certain courses. Here, a golfer mounts his/her clubs on the motorized cart and drives across the course from ball lie to ball lie.

The present invention concerns those persons who walk a golf course and carry a set of clubs. This invention is thus useful for a substantial number of golfers who desire walking a golf course as a means of healthy, enjoyable exercise. One of the drawbacks which has long existed for these golfers prior to the present invention, however, is the nature of the construction of the standard golf bag. Here, the typical golf bag which receives the set of clubs is in the form of a generally tubular carrying member enclosed at one end so that the shafts of the clubs may be longitudinally received in the bag. A single strap extends from the upper rim of the golf bag to a midpoint on the bag. The golfer or the caddy then carries such bag by inserting one arm through the strap so that the strap extends across one shoulder thus supporting the bag for travel. A small handle may also be mounted on the bag, normally between the end points of the strap, to enable the bag to be carried by the human hand.

A disadvantage to this system has long been present, though, and is readily realized by persons who carry golf bags over a golf course. This problem results from the fact that the entire weight of the golf clubs and bag, which may typically be on the order of twenty to twenty-eight pounds, tires the shoulder of the carrier. The weight of the bag strains the muscles of the neck and shoulder unduly and further causes muscular strain resulting from the imbalanced nature of this method of carriage. Indeed, the imbalance can cause associated muscle soreness in the hips and lower back due to the fact that the center of gravity of the bag is offset with respect to the spine. This is of particular concern to those golfers who experience back problems.

Despite the long-felt need for a better carrying system for golf bags, there has been virtually no development of alternates to the above-described structure. There is such a need for a carrying system that can be manufactured both by original equipment on a golf bag and which can be retrofitted onto other golf bags of common manufacture. There is a further need for such a carriage system that is simple to use and enhances the game of golf for those who normally carry their golf bags.

SUMMARY OF THE INVENTION

It is an object of the present invention to provide a new and useful golf bag carrying system which may be employed by persons who carry golf bags during a round of golf.

Another object of the present invention is to provide an improved strap system for carrying golf bags which may be employed as a retrofit system for different types of styles of bags or may be manufactured in conjunction with the construction of a golf bag when it is originally produced.

A further object of the present invention is to provide a dual shoulder strap device to allow a golf bag to be carried in a centered manner on the back of a human carrier.

Yet another object of the present invention is to provide a dual strap golf bag carrying device wherein the weight of a golf bag may be simultaneously supported by both shoulders of the golf bag carrier; or, in the alternative, may be carried by a single strap on one shoulder, if desired, in the traditional manner.

A still further object of the present invention is to provide a dual strap carrying system for golf bags that is easy and convenient to use and is more comfortable and balanced for the carrier of a set of golf clubs.

Yet another object of the present invention is to provide a dual strap carrying system for golf bags that is helpful for the carrier of a set of golf clubs both in lifting the bag from the ground and in use and which is adjustable in length and in circumferential points of suspension to accommodate different physiques.

In accordance with the present invention, a golf bag carrying system is provided in the form of a dual strap carrier device that either may be manufactured in conjunction with the construction of a golf bag, as original equipment, or which may be manufactured as a retrofit system attachable to a standard golf bag. To this end, in its broad form, the present invention is in the form of a strap assembly for use with a golf bag wherein the golf bag is in the form of an elongated generally tubular member or enclosure having a surrounding sidewall or frame, a closed end and an open end whereby the shafts of golf clubs may be inserted into the open end. The strap assembly is disposed externally of the sidewall or frame and includes first and second strap members, each of the strap members having opposite ends, first and second securing means for securing each of the opposite ends of the first strap member to longitudinally spaced locations on the sidewall or frame including a first location proximate the open end and a second location longitudinally spaced from the first location whereby the first strap member defines a first strap opening through which one arm of the person can be inserted, and third and fourth securing means for securing each of the opposite ends of the second strap member to longitudinally spaced locations on the sidewall whereby to define a second strap opening so located with respect to the first strap opening that another arm of the person can be inserted through the second strap opening and the golf bag supported on both shoulders of the person carrying the golf bag.

Preferably, one end of the first strap member is fastened together with one end of the second strap member at an intermediate or central portion between the strap members and are connected to a common central mounting element or handle portion which is affixed to the sidewall of the bag. Although the strap members are flexible, the additional thickness at their connected ends will stiffen the strap members at that location so as to elevate the strap members when the golf bag is resting on the ground to facilitate lifting as well as to facilitate insertion of the arms through the strap openings. The fastened-together ends of the strap members may be structured as a unitary strip extending around the central mounting element which may further be connected to a releasable mounting structure on an intermediate portion of the golf bag between the strap members for securing the central portion of the strap assembly to the golf bag.

The preferred form of strap assembly is especially useful on a golf bag having a handle portion located on the sidewall and extending longitudinally of the central portion. The connected ends of the first and second strap members may include a mounting ring and a flexible mounting web which is adjustably wrapped around the handle to attach the connected ends thereto. Thus the handle defines the second location for attachment of the strap assembly to the golf bag and defines the primary balance point for carrying the bag. Opposite ends of the strap member to the connected end each may include releasable mounting means, such as, a swivel clip or adjustable mounting web for releasable attachment to the sidewall and include means for adjusting the respective effective lengths of the first and second strap members. Each of the strap members is preferably of curvilinear configuration for greater comfort and to facilitate positioning of the straps on the carrier's shoulders. Furthermore, the golf bag may be provided with a pillow element or concave portion formed in the sidewall and circumferentially offset from the attachment axis approximately 90° to rest against the back of a person when the golf bag is in a fully supported position.

The strap assembly described above may be employed with existing golf bags having a top mounting element, a handle and a bottom mounting element wherein the top and bottom mounting elements traditionally secure a unitary carrying strap for such traditional golf bags. However, this strap assembly may also be implemented with a specially constructed golf bag wherein a different structure is utilized for the upper and lower mounts. For example, in the exemplary embodiment of the present invention, a first mount located proximate the open end of the bag is in the form of a first mounting strip extending circumferentially around at least a limited portion of the enclosure on one side of the attachment axis, and a first slide ring is slidably received on the first mounting strip so that the mounting ring is movable along the first mounting strip to locations circumferentially along one side of the attachment axis. The bottom mount may include a second mounting strip extending circumferentially around at least a limited portion of the tubular body on one side of the attachment axis and a second slide ring slidably received on the second mounting strip so that it is movable to locations circumferentially to one side of the attachment axis. Both mounting strips may be movable longitudinally of the tubular body to adjust for different shoulder widths and may extend completely around the tubular body to cradle the tubular body when the golf bag is fully supported.

The above and other objects of the present invention will become more readily appreciated and understood from a consideration of the following detailed description of the preferred embodiment when taken together with the accompanying drawings, in which:

BRIEF DESCRIPTION OF THE DRAWINGS

FIG. 10 is a top plan view illustrating the strap members of the preferred form of strap assembly of FIGS. 7 and 8 when disconnected from the bag and in a flattened condition;

FIG. 11 is a cross-sectional view taken about lines 11—11 of FIG. 10; and FIG. 12 is an enlarged fragmentary view in more detail of the interconnection of the strap members of the preferred form of FIGS. 8 to 11 to the handle portion.

DETAILED DESCRIPTION OF THE PREFERRED EMBODIMENT

The present invention is directed to a golf bag assembly that uses a new and useful strap assembly enabling a golfer or other person to conveniently carry a golf bag on both shoulders, although the structure described allows carriage of the golf bag on a single shoulder as well. The strap assembly of the present invention may be manufactured as original equipment on a golf bag or manufactured separately for retrofit attachment to existing golf bags. In either case, the invention, when used in conjunction with a golf bag, broadly includes a pair of straps which are connected to and oriented longitudinally along a golf bag to define an attachment axis A. A first strap 14 has a first end connected to an upper portion of the golf bag and a second end connected to an upper midportion of the golf bag that is longitudinally spaced from the upper portion. The second strap has a first end that is connected to the midportion of the golf bag at or proximate to the location of the attachment point of the second end. The second strap has a second end that is connected to a lower portion of the golf bag longitudinally spaced from the midportion. These straps may then be mounted respectively over the left and right shoulders of a person who is to carry the golf bag so that the golf bag is suspended from both shoulders to hang across the person's back, and the weight of the bag is evenly distributed between the shoulders.

Figure 1:
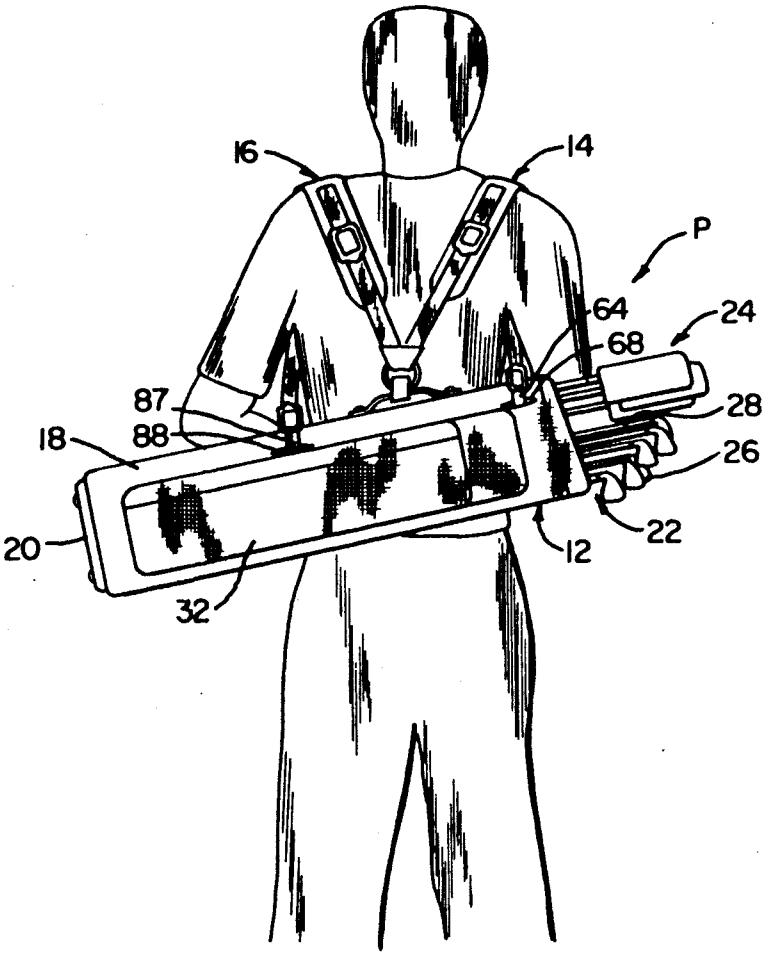
FIG. 1 is a perspective rear view of a person carrying a golf bag utilizing the present invention with the golf bag shown in a carrying position for a righthand orientation.

The exemplary embodiments of this invention may be seen with respect to the figures. In FIG. 1, for illustration purposes, a first form of golf bag 12 is carried in a fully supported state by a first strap 14 and a second strap 16. The golf bag 12 is in the form of an elongated enclosure or tubular body having a surrounding sidewall 18, a closed end 20 and an open end 22 so that a set of golf clubs 24 may be inserted through the open end for storage and transport. To this end, each golf club of the set of clubs 24 includes a head, such as head 26 and a shaft, such as shaft 28. Auxiliary compartments 30 and 32 are provided to permit transport of auxiliary golf equipment and, as noted below, are oriented to counterbalance the weight of the golf bag and clubs.

Figure 2:
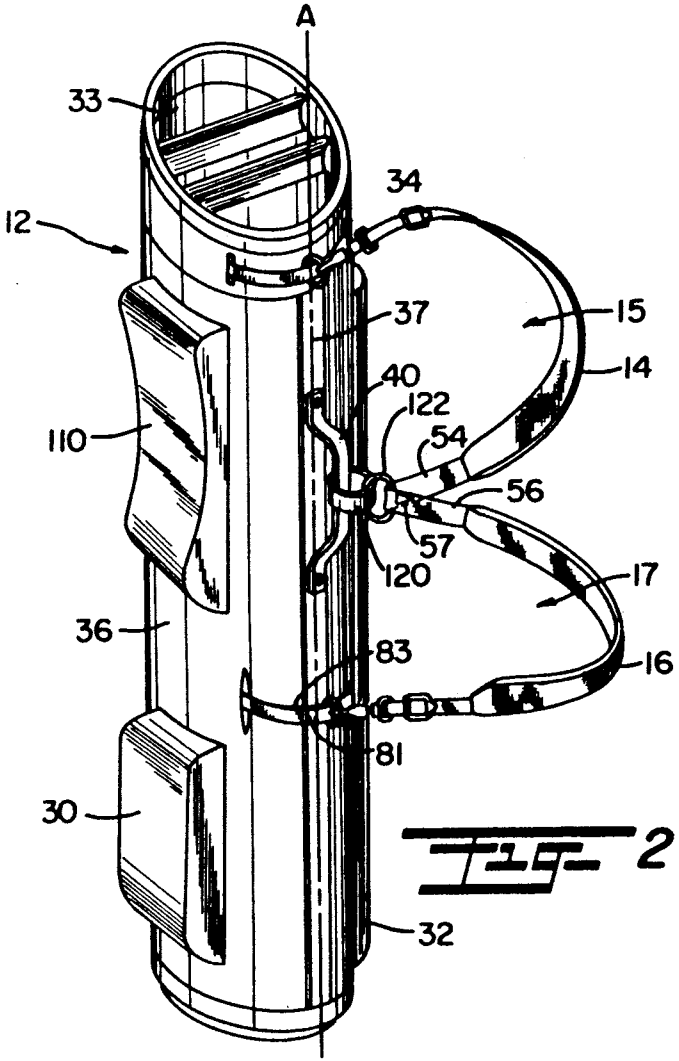
FIG. 2 is a perspective view of a golf bag assembly according to the present invention with a back pad secured thereto.

The golf bag structure implementing the present invention is shown in greater detail in FIGS. 2–6. In these figures, it may be seen that golf bag 12 has a handle 40 located above a midportion of golf bag 12. First strap 14 defines an upper primary strap and has a first end 52 which is secured to golf bag 12 at a first location along an upper end portion 34 adjacent to the open end 22. A second lower end 54 of the strap 14 is secured to the golf bag 12 at a second location just above a midportion thereof and, to this end, second end 54 is secured to handle 40 as more thoroughly described below. The lower strap 16 has a first upper end 56 secured above the midportion of golf bag 12, preferably to handle 40, and the strap 16 has a lower end 58 secured to the golf bag 12 at a third location longitudinally spaced from the point of attachment of ends 54 and 56 and toward a lower portion of golf bag 12. Thus, as shown in FIG. 2, the first, second and third locations define a longitudinal attachment axis A. A wedge-shaped structure 33 is mounted in open end 22 diametrically opposite axis A and operates to help prevent inadvertent dislodgment of the golf clubs from the golf bag 12 during use.

Figure 3:
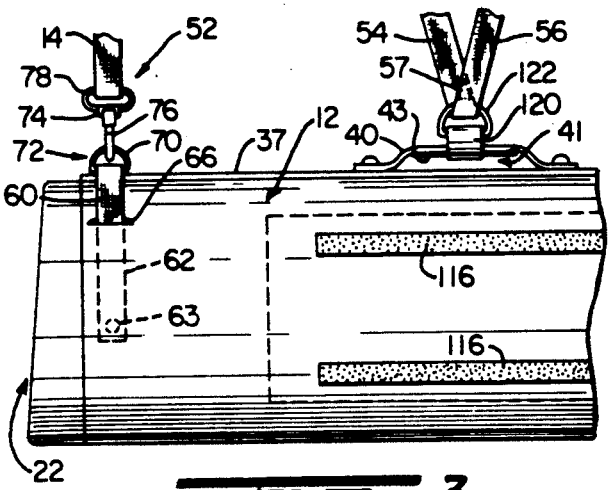
FIG. 3 is a side view in elevation showing the top portion of the golf bag of FIG. 2 with the back pad removed.
Figure 4:
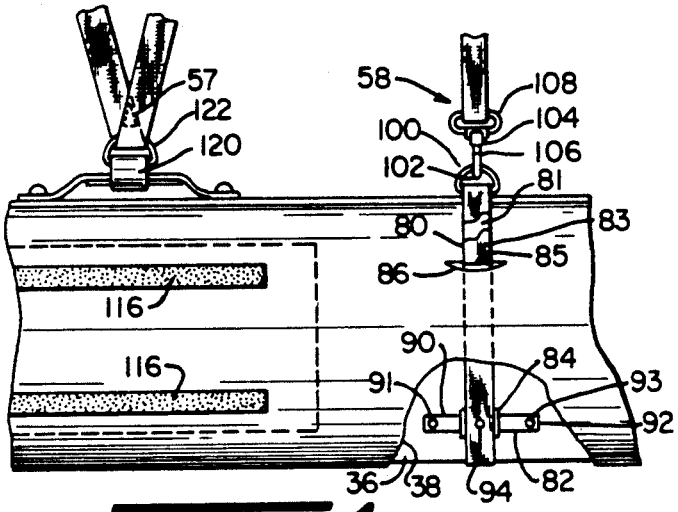
FIG. 4 is a side view in elevation and partially broken away of a midportion of the golf bag shown in FIG. 2 with the back pad removed.

As may be see with greater particularity with reference to FIGS. 2–4, the golf bag 12 has an inner generally cylindrical shell or plastic tube 36 joined at spine 37 along the attachment axis, although it will be apparent that the shell may be endless and not require a spine 37. Shell 36 is covered by a covering 38 of cloth, vinyl or the like. An upper circumferential mounting strap 60 has end portions 62 and 64 secured at spaced diametric locations on upper end portion 34 of golf bag 12. As is shown in phantom in FIG. 3, this may be to shell 36 by means of a rivet 63 or other convenient form of attachment. Accordingly, end portions 62 of strap 60 extends through slits 66 and 68, respectively, in covering 38, so that they may be secured to cylindrical shell 36. Alternately, mounting strap 60 could extend completely around shell 36 to cradle the golf bag 12.

As further shown in FIG. 3, the shoulder strap 14 is mounted to golf bag 12 by means of a mounting ring 70 which is slidably mounted on strap 60 and can move circumferentially on either side of attachment axis A. To this end, the strap 60 is received through the opening in the mounting ring 70. Clasp 74 is a swivel clip having a clip head 76 that may be releasably fastened onto mounting ring 70 and, at the opposite end from head 76, includes a ring 78 to which the webbing strip 52 is secured, as discussed below.

Referring to FIG. 4, it may be seen that the lower end 58 of the strap 16 is mounted to golf bag 12 by means of a second circumferential mounting strap 80 which encircles the golf bag 12 beneath the covering 38. Strap 80 passes through slits 86 and 88 in the covering 38 on opposite sides of golf bag 12, as is shown in FIGS. 1 and 4, with slits 86 and 88 each being offset approximately thirty degrees circumferentially of attachment axis A. The strap 80 preferably includes two strap sections 81 and 83 secured together at ends 85 and 87, respectively, and strap 80 is mounted for limited longitudinal sliding movement by means of a longitudinal band 82 which has opposite ends 90 and 92 riveted to cylindrical shell 36 by means of rivets 91 and 93, respectively A slide bracket 84 is slidably mounted on band 82 for longitudinal sliding movement between rivets 91 and 93, and mounting strap 80 is attached to slide bracket 84 by means of a rivet 94. A mounting ring 100 has an opening that receives mounting strap 80 so that mounting ring 100 may slide circumferentially between strap sections 81 and 83 and between circumferential limits defined by attached ends 85 and 87. A swivel clip 104 includes a clip head 106 that may be releasably fastened onto mounting ring 100 and a ring 108 is located opposite to clip head 106 to receive a webbing strip again as discussed below.

The lower end 54 of upper strap 14 and upper end 56 of lower strap 16 are each secured at a location that is longitudinally spaced between mounting straps 60 and 80. In the preferred embodiment, these ends are attached together to form a common central portion 55 of the strap assembly, and connection to golf bag 12 is accomplished to handle 40 by means of a single releasable mounting strap assembly 120 described below in greater detail. To this end, however, mounting strap assembly 120 includes a large D-ring 122 and, as may be seen in the embodiment shown in FIG. 2, ends 54 and 56 are secured to one another and around D-ring 122 by means of stitching as designated at the central portion 55.

It may be seen from the foregoing that upper strap 14 is secured at a first location proximate the open end 22 of golf bag 12 and at a second location longitudinally spaced from the first location so that the strap 14 defines a first strap opening 15 sized to accommodate one of the shoulders of a person who seeks to carry golf bag 12. The lower strap 16 has an upper end 56 thus secured to the golf bag at the central location and has a lower end 58 secured at a lower location longitudinally spaced from the central location between the central location and closed end 20 to define a second strap opening 17 sized to receive the other shoulder of the person who seeks to carry golf bag 12. Accordingly, a person may carry the golf bag by inserting each arm successively through strap openings 15 and 17 so that the golf bag 12 may be supported by the shoulders and suspended transversely across the back, as is shown in the righthand orientation of FIG. 1. It should be understood, however, that the golf bag could be carried with the club heads projecting to the left, that is, in a lefthand orientation opposite that orientation, shown in FIG. 1 with the structure described herein reversed as would be evident to the ordinarily skilled person in this field of invention.

Figure 5:
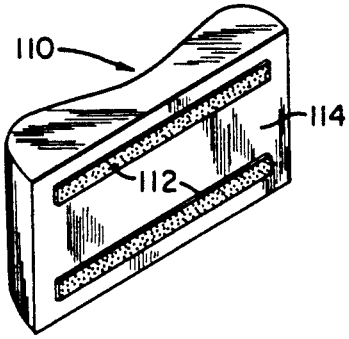
FIG. 5 is a rear perspective view of the back pad according to the present invention used in conjunction with the golf bag of FIG. 2.

In order to further increase the comfort of carrying golf bag 12, a back cushion or pillow 110 may be provided, if desired, with this pillow being illustrated in FIG. 5. Here, pillow 110 may be constructed of any cushioning material or construction and is preferably concave in shape to conform to the human back. Pillow 110 includes a pair of mating hook and loop fasteners including strips 112 oriented longitudinally across its back panel 114. Mating VELCRO strips 116 are longitudinally oriented on the exterior of sidewall 18 of golf bag 12 circumferentially offset from the attachment axis A. Strips 112 are preferably filaform elements while strips 116 are the matching loop elements defining the mated pair. Strips 116 extend from a location approximately midway between the first and second attachment locations of first strap 14 to a location approximately midway between the points of attachment of second strap 16. Pillow 110 is secured to golf bag 12 by the mating action of strips 112 and 116 so that it is centrally positioned on the back of the wearer when golf bag 12 is mounted in the position shown in FIG. 1.

Figure 6:
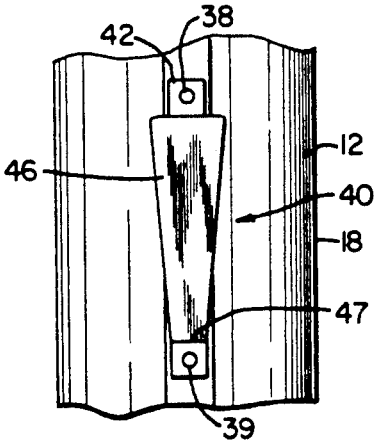
FIG. 6 is a front view in elevation of the handle portion of the golf bag shown in FIG. 2.
Figure 7:
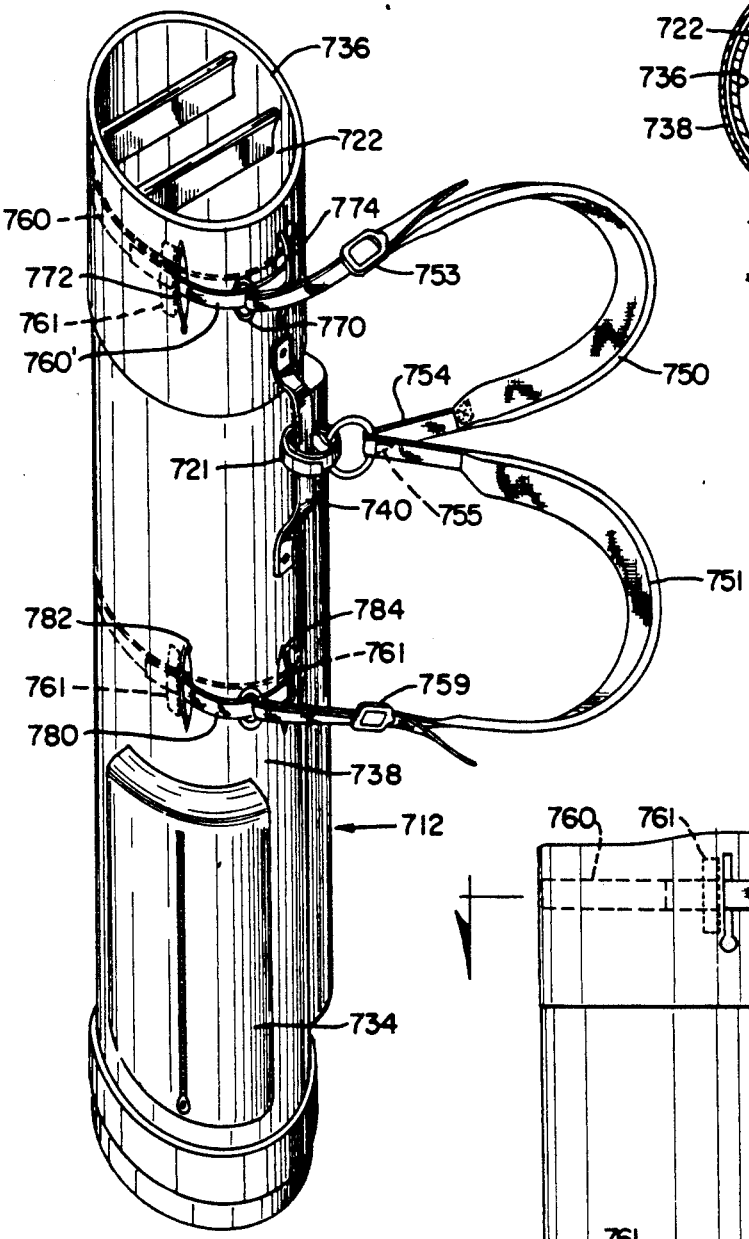
FIG. 7 is a perspective view of another preferred form of golf bag in accordance with the present invention.

Handle 40 is best shown in FIG. 6 where it may be seen that handle 40 has opposite handle ends 42 and 44 which are respectively secured to sidewall 18 of golf bag 12 by rivets 38 and 39. Handle 40 has a central portion 46 that is tapered so that it is narrower at the end thereof proximate closed end 20 and is wider at the end thereof proximate open end 22. As described below, this construction helps facilitate the use of first strap 14 independently of second strap 16.

From the foregoing, the golf bag and strap assembly according to the present invention is employed to facilitate the transport of a golf bag by a person during the game of golf. A strap assembly, such as strap assembly 13, is secured to handle 40 at D-ring 122 in the manner described at a selectably adjustable longitudinal location to balance the golf bag and clubs. Swivel clips 74 and 104 are respectively attached to D-rings 70 and 100 so that, for the desired orientation of golf bag 12, pads 116 and 126 will extend over the shoulders. The distance between the strap end 52 and strap end 54 is selected by the point of attachment of strap assembly 42 to handle 44 to accommodate the width of the shoulders, and the effective lengths of straps 14 and 16 are adjusted for the length of the person's torso, as desired for comfort. The distance between strap end 56 and strap end 58 is automatically adjusted since the position of circumferential mounting strap 80 may be adjusted in location by means of slide bracket 84 sliding on band 82. It may be further seen that circumferential positioning is automatically accommodated by the slippage of D-rings 70 and 100 circumferentially around their respective mounting straps 60 and 80.

The handle 40 also provides a convenient "one-handed" lift for golf bag 12 when the golf bag is not worn on the shoulders. Further, for carrying golf bag 12 a short distance, it is sometimes desirable that a single carrying strap be used. To this end, the strap 14 provides a primary carrying strap that may be placed over one of the person's shoulders and strap 16 is left in a dangling state. It may now be appreciated that the tapered construction of handle 40 shown in FIG. 6 helps to prevent any slippage of releasable strap assembly 120 longitudinally of central portion 46 of handle 40. That is, once releasable strap assembly 13 is mounted on handle 40, the increasing width of central portion 46 and the resistance of releasable strap assembly 120 to increase in size once it is wrapped around handle 40 and secured prevents upward longitudinal slippage.

DETAILED DESCRIPTION OF ANOTHER PREFERRED FORM OF INVENTION

Yet another embodiment of a golf bag especially constructed to implement the present invention is shown in FIG. 7 to 12. Here, golf bag 712 includes an elongated enclosure in the form of a cylindrical shell 736 covered by a suitable cloth or vinyl covering 738. The golf bag 712 has an open end 722 for lengthwise insertion of golf clubs, and auxiliary compartments on the exterior of the covering 738 include a clothes compartment 732 for larger articles and a ball pocket 734.

A handle 740 is attached to an upper portion of the shell 736 by suitable rivets 735 passing through upper and lower ends of the handle 740, the handle extending in a direction lengthwise of the bag. In order to accommodate the dual strap carrying assembly of the present invention, the bag 712 is provided with first and second anchor straps 760 and 780. As seen from FIGS 7 and 8, the strap 760 extends circumferentially beneath the covering 738 proximate the open end 722, and a loop portion 760' extends outwardly from attachment to the strap 760 between slits 772 and 774 in the cover 738. The loop 760' is oversized with respect to the circumference of the shell so as to be loosely disposed in outer spaced relation to the shell in the region between the slits 772 and 774. The slit 774 is formed in the cover 738 at a location spaced lengthwise from and above the handle 740 while the slit 772 is circumferentially spaced approximately 60° away from the slit 774 and correspondingly displaced from the handle 740.

The lower anchor strap 780 correspondingly extends circumferentially underneath the cover 738 below the handle 740 and around the midportion of the bag with a loop portion 780' of the strap 780 exposed between slits 782 and 784. The slits 782 and 784 are aligned with the slits 772 and 774, and the anchor strap 780 is spaced beneath the handle 740 a distance substantially corresponding to the spacing of the strap 760 above the handle.

It will be noted that the slits 772, 774 and 782, 784 each is of a length greater than the width of a respective strap 760, and loop 760', 780' 780 to permit longitudinal shifting of the straps and loops. Most desirably, the straps 760, 780 and associated loops 760', 780' are longitudinally adjustable to modify their spacing with respect to the handle 740 by fastener strips which are affixed to the shell 736 and the inside of the covering 738 at the entrance to each of the slits 772, 774 and 782, 784. In the following, the attachment mechanism will be described at the entrance to one of the slits 772, it being understood that there is a corresponding attachment mechanism for each of the other slits 774, 782 and 784. Thus, at the entrance to the slit 772, elongated fastener strips 761 and 761' extend in a lengthwise direction to the bag and in face-to-face relation to one another directly inside of the entrance to the slit 772 with the strip 761 attached to the shell 736 and the strip 761' attached to the inside of the covering 738. The strap 760 includes a complementary fastener strip 763 on its inner surface for releasable attachment to the strip 761 on the shell 736, and the loop 760' includes a fastener strip 763' for releasable attachment to the strip 761' on the inside of the covering. Preferably, the fastener strips 761, 761' and 763, 763' are composed of a filamentary material, such as, VELCRO having complementary hook and loop surfaces so that the golfer may easily adjust the spacing of each strap 760 and loop 760' by reaching in with the fingers and manually adjusting the position of the complementary fastener strips 763 and 763' with respect to the stationary fastener strips 761 and 761'. In this relation, it will be noted that opposite ends of each loop portion 760' and 780' are permanently affixed, such as, by sewing to their respective anchor straps 760 and 780 at locations 762 and 782, respectively, inwardly and beyond the location of the fastener strips at the entrance to each of the slits.

A preferred form of shoulder strap assembly is made up of upper and lower interconnected shoulder strap portions 750 and 751, respectively, the upper shoulder strap 750 provided with a mounting ring 770 which is slidable on the loop 760' and receives a looped end portion 752 at the upper end of the strap 750. Another mounting ring 790 receives a loop end portion 758 at the lower end of the shoulder strap 751, and the ring 790 is slidable on the lower loop 780'. Each of the end portions 752 and 758 is length-adjustable by suitable means, such as, adjustable buckles 753 and 759, respectively.

The shoulder straps 750 and 751 have adjoining ends 754 which are interconnected to one another by seaming together as at 755 so as to form a common loop portion 756 therebetween for insertion of a mounting ring 720. A VELCRO loop 721 is passed through the mounting ring 720 and is wrapped in surrounding relation to the handle 740. An elongated fastener strip 741 is disposed along the inner surface of the handle 740 and is of a VELCRO material complementary to a filamentary material disposed along the inner surface of the loop 721. Preferably, the loop 721 comprises an elongated flexible strip of material which can be wrapped into the form of a band or ring interconnecting the mounting ring 720 to the handle 740 and is of course longitudinally adjustable by manipulating the disposition of the loop along the length of the fastener strip 741, as best seen from FIGS. 11 to 13.

Figure 9:
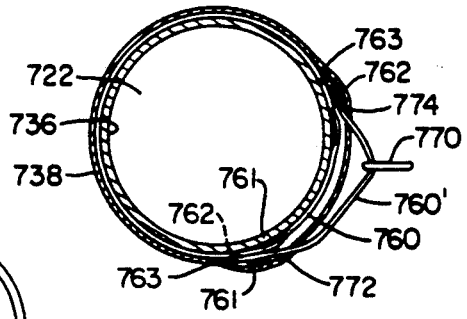
FIG. 9 is a cross-sectional view taken about lines 9—9 of FIG. 8.
Figure 8:
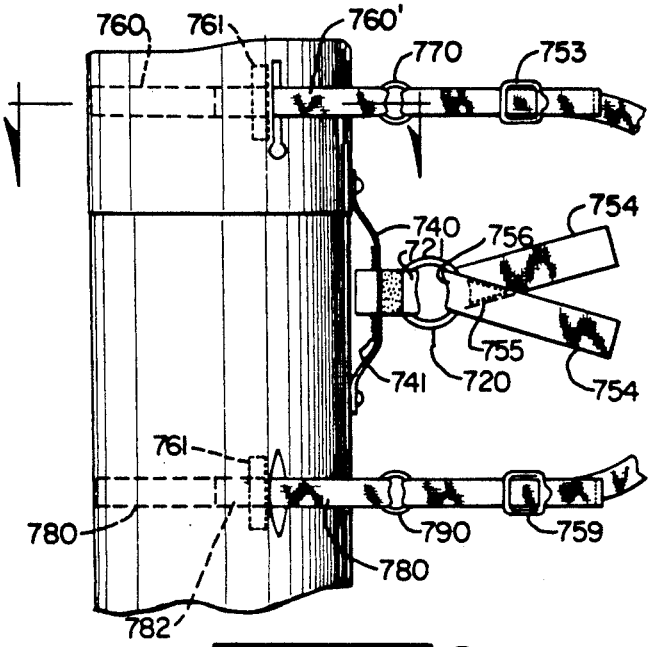
FIG. 8 is a fragmentary view in elevation of another preferred form of strap assembly shown in FIG. 7.

As further illustrated in FIGS. 8, 9 and 11, the shoulder straps 750 and 751 each include an elongated padded section 728 having spaced, substantially parallel seams 729 extending the length of the padded sections and terminating at the juncture of the end portions 752 and 754 with the ends of the padded sections 728 and at which point the end portions 752 and 754 are securely attached by sewing to the ends of the padded sections as designated at 758 and 759, respectively. A unique feature of the shoulder straps is that each of the flexible padded sections 728 is of curvilinear configuration or, in other words, the central axis of each padded section extends along a gradual curve in the plane of each section 728. Thus, as illustrated in FIG. 10, the shoulder straps when laid out in a flattened condition unattached to the bag will diverge away from their common connection 755 to the mounting ring 720. The curvilinear configuration of the straps has been found to better conform to the shoulders when attached to the bag and placed in carrying position as previously described.

Preferably, the end portions 752 and 754 are correspondingly formed of a flexible but high strength webbing material. However, by joining together over a relatively broad seam area as represented at 755, an additional degree of stiffness is lent to the adjoining ends of the portions 754 at their attachment above the handle 740 so that the end portion 754 will tend to extend in an upward direction away from the handle when the bag is placed on the ground. This will of course enable the golfer to more easily grasp the upper strap portion when the bag is picked up and replaced on the shoulders.

Referring again to FIGS. 7 and 8, another important feature of the shoulder strap assembly is the placement of the loops 760 and 780 with respect to the handle portion 740. Accordingly, for a righthanded golfer who will tend to carry the upper strap 750 on the right shoulder and the lower strap 751 on the left shoulder it is desirable that the mounting rings 770 and 790 be movable between a position at or adjacent to the slits 774 and 784 in substantial axial alignment above and below the handle portion 740; yet the mounting rings 770 and 790 will be free to slide in a clockwise direction away from the handles 740 toward the slits 772 and 782 so that the suspension points are free to shift and remain centered above the weight of the bag and in this way permit the bag to more closely ride against the body. At the same time, the curvilinear shoulder straps will when placed on the shoulders lay flat against the shoulders and relatively near the neck so as not to tend to slip off. Moreover, the lower ends of the straps will tend to lay flush against the sides of the carrier beneath the armpits and minimize any tendency to slide along or chafe the body of the carrier.

It is therefore to be understood that while alternate preferred forms of the present invention have been herein set forth and described, various other modifications and changes may be made without departing from the spirit and scope of the invention as defined by the appended claims and reasonable equivalents thereof.

I claim:

1. In a golf bag to be carried by a person, said golf bag having an elongated enclosure including a surrounding sidewall, a closed end and an open end whereby golf clubs may be inserted lengthwise into said golf bag through the open end, the improvement comprising:

a shoulder strap assembly disposed externally of said sidewall including first and second strap members, each of said strap members having opposite ends;

first and second securing means for securing each of said opposite ends of said first strap member to longitudinally spaced locations on said sidewall including a first location proximate said open end and a second location longitudinally spaced from said first location whereby said first strap member defines a first strap opening through which one arm of the person can be inserted; and third and fourth securing means for securing each of said opposite ends of said second strap member to longitudinally spaced locations on said sidewall whereby to define a second strap opening so located with respect to said first strap opening that another arm of the person can be inserted through said second strap opening and said golf bag supported on both shoulders of the person carrying said golf bag; and said second and third securing means including stiffening means therebetween for holding said first and second strap members in a raised position away from said enclosure.

2. In a golf bag according to claim 1, said third securing means securing one end of said second strap member to a location proximate to said second location, and said fourth securing means securing the other of said opposite ends of said second strap member to a third location spaced below said third securing means on said sidewall.

3. In a golf bag according to claim 2, said first and fourth securing means each including a circumferentially extending loop portion spaced radially outwardly of said sidewall, and slidable mounting means slidably connecting each of said first and second strap members to a respective one of said loop portions whereby said first and second strap members are slidable circumferentially along said loop portions.

4. In a golf bag according to claim 3, each of said loop portions including means adjustably attaching opposite ends of said loop portions to said sidewall whereby to adjust the longitudinal spacing between said first and fourth locations and said second and third locations.

5. In a golf bag according to claim 4, said sidewall including an inner substantially rigid shell and an outer flexible covering in surrounding relation to said shell, said opposite ends of each of said loop portions extending through circumferentially spaced openings in said covering, and each of said first and fourth securing means including a circumferential strap between said covering and said shell with said opposite ends of said loop portions connected to a respective one of said circumferential straps.

6. In a golf bag according to claim 3, each of said loop portions having one end in longitudinal alignment with said second location and the other of said opposite ends of said loop portions circumferentially offset in the same direction away from said one end.

7. In a golf bag according to claim 1, each of said first and second strap members being of curvilinear configuration in the plane of each of said respective strap members.

8. In a golf bag according to claim 1, said second and third securing means including a common handle attached to said sidewall and adjustable connecting means for adjustably connecting said first and second strap members to said handle.

9. In a golf bag according to claim 8, said second and third securing means including said stiffening means joining the proximate ends of said first and second strap members together adjacent to said adjustable connecting means.

10. In a golf bag to be carried by a person, said golf bag having an elongated enclosure including a surrounding sidewall, a closed end and an open end whereby golf clubs may be inserted lengthwise into said golf bag through the open end, the improvement comprising:

a strap assembly disposed externally of said sidewall including first and second strap members, each of said strap members having opposite ends;

a handle attached to said sidewall;

first and second securing means for securing each of said opposite ends of said first strap member to longitudinally spaced locations on said sidewall including a first location proximate said open end and a second location at said handle whereby said first strap member defines a first strap opening through which one arm of the person can be inserted; and third and fourth securing means for securing each, of said opposite ends of said second strap member to longitudinally spaced locations including the second location at said handle and a third location below said handle whereby to define a second strap opening so located with respect to said first strap opening that another arm of the person can be inserted through said second strap opening and said golf bag supported on both shoulders of the person carrying said golf bag; and including a flexible loop member adjustably interconnecting said second and third securing means to said handle, said second and third securing means including stiffening means joining proximate ends of said first and second strap members together, and means interconnecting said stiffening means to said flexible loop member.

11. In a golf bag according to claim 10, said first and fourth securing means each including a circumferentially extending loop portion spaced radially outwardly of said sidewall, and slidable mounting means slidably connecting each of said first and second strap members to a respective one of said loop portions whereby said first and second strap members are slidable circumferentially along said loop portions, and each of said loop portions including means adjustably attaching opposite ends of said loop portions to said sidewall whereby to adjust the longitudinal spacing between said first and fourth locations and said second and third locations.

12. In a golf bag according to claim 11, said sidewall including an inner substantially rigid shell and an outer flexible covering in surrounding relation to said shell, said opposite ends of each of said loop portions extending through circumferentially spaced openings in said covering, and each of said first and fourth securing means including a circumferentially extending strap between said covering and said shell with said opposite ends of said loop portions connected to a respective one of said circumferential straps.

13. In a golf bag according to claim 10, each of said first and second strap members having a flexible webbing strip at said proximate ends thereof, said stiffening means maintaining said proximate ends in a raised position when said golf bag is on the ground whereby to enable the person carrying the golf bag to grasp said first strap member and to pass the arms through said strap openings.

* * * * *